US007107912B2

(12) United States Patent
Schütz

(10) Patent No.: US 7,107,912 B2
(45) Date of Patent: Sep. 19, 2006

(54) PALLET-TYPE SUPPORT FRAME FOR TRANSPORT AND STORAGE CONTAINERS FOR LIQUIDS

(75) Inventor: Udo Schütz, Westerwald (DE)

(73) Assignee: Protechna S.A., Fribourg (CH)

( * ) Notice: Subject to any disclaimer, the term of this patent is extended or adjusted under 35 U.S.C. 154(b) by 0 days.

(21) Appl. No.: 10/993,400

(22) Filed: Nov. 19, 2004

(65) Prior Publication Data

US 2005/0115473 A1 Jun. 2, 2005

(30) Foreign Application Priority Data

Nov. 27, 2003 (DE) ..... 103 55 421

(51) Int. Cl.
*B05D 14/38* (2006.01)

(52) U.S. Cl. ..... 108/55.1; 108/57.32

(58) Field of Classification Search ..... 108/55.1, 108/55.3, 55.5, 51.11; 206/306, 599
See application file for complete search history.

(56) References Cited

U.S. PATENT DOCUMENTS 4,007,694 A * 2/1977 Fowler et al. ..... 108/55.1
4,051,787 A * 10/1977 Nishitani et al. ..... 108/55.3
4,254,873 A * 3/1981 Cook et al. ..... 206/599
4,397,246 A * 8/1983 Ishida et al. ..... 108/55.3
5,052,307 A * 10/1991 Morrison ..... 108/53.1
6,186,078 B1 * 2/2001 Brown ..... 108/57.25
6,644,220 B1 * 11/2003 Gangloff et al. ..... 108/57.32
6,668,735 B1 * 12/2003 Cassina ..... 108/57.25
6,675,723 B1 * 1/2004 Sukeva ..... 108/55.1
6,745,704 B1 * 6/2004 Carter et al. ..... 108/55.1

* cited by examiner

*Primary Examiner*—Jose V. Chen
(74) *Attorney, Agent, or Firm*—Friedrich Kueffner

(57) ABSTRACT

A pallet-type support frame for transport and storage containers for liquids having an inner plastic container and an outer metal jacket has a sheet metal bottom for supporting the inner container. The bottom has a shape matched to the drainage bottom or the flat bottom of the inner container. Anti-slip support elements are arranged on the underside of the bottom such that the support frame rests with the support elements on gripping arms of a transport device. Alternatively, an anti-slip coating is provided on the underside of the bottom. The coating is engaged by gripping arms of the transport device when the support frame is transported. The support elements or anti-slip coatings are made of a material that is matched to a material of the gripping arms such that a friction coefficient as great as possible is provided between the support elements or anti-slip coatings and the gripping arms.

9 Claims, 4 Drawing Sheets

Fig. 2
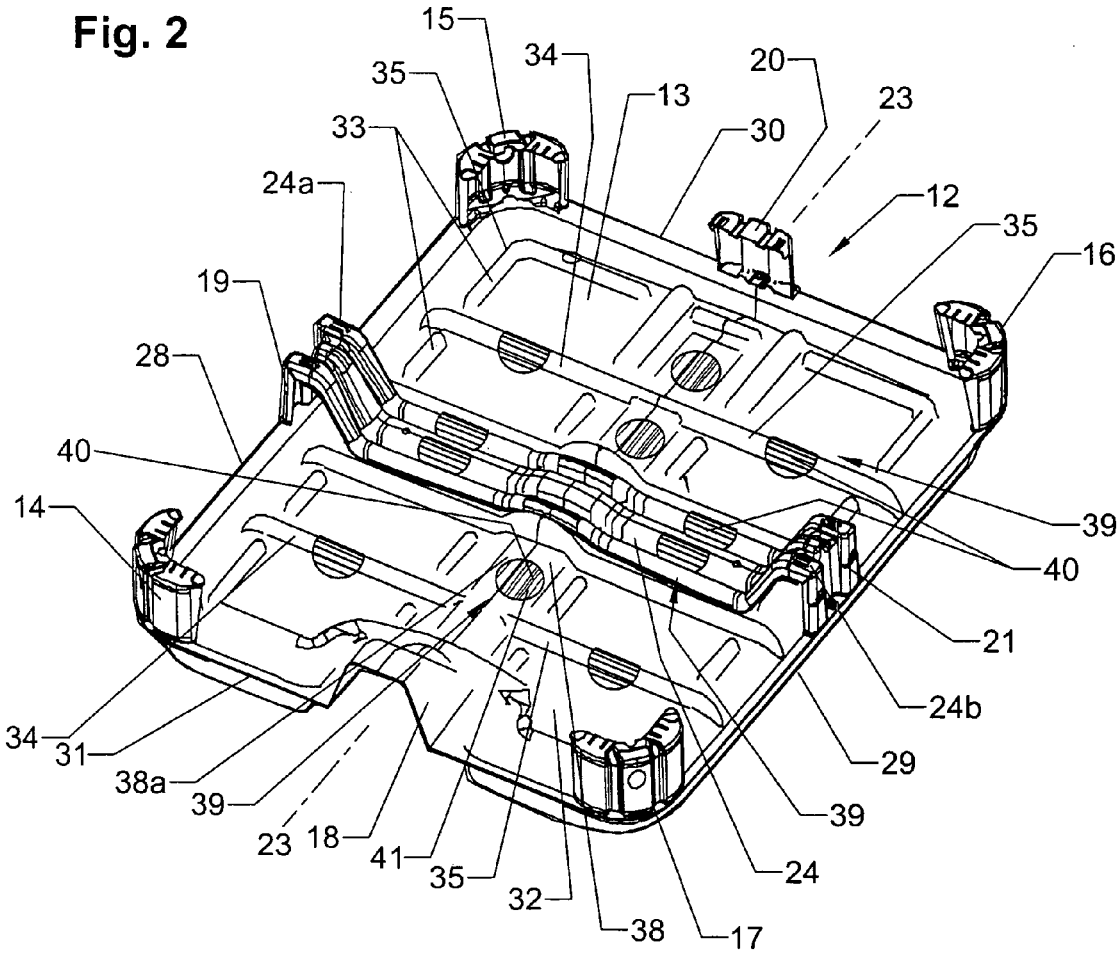
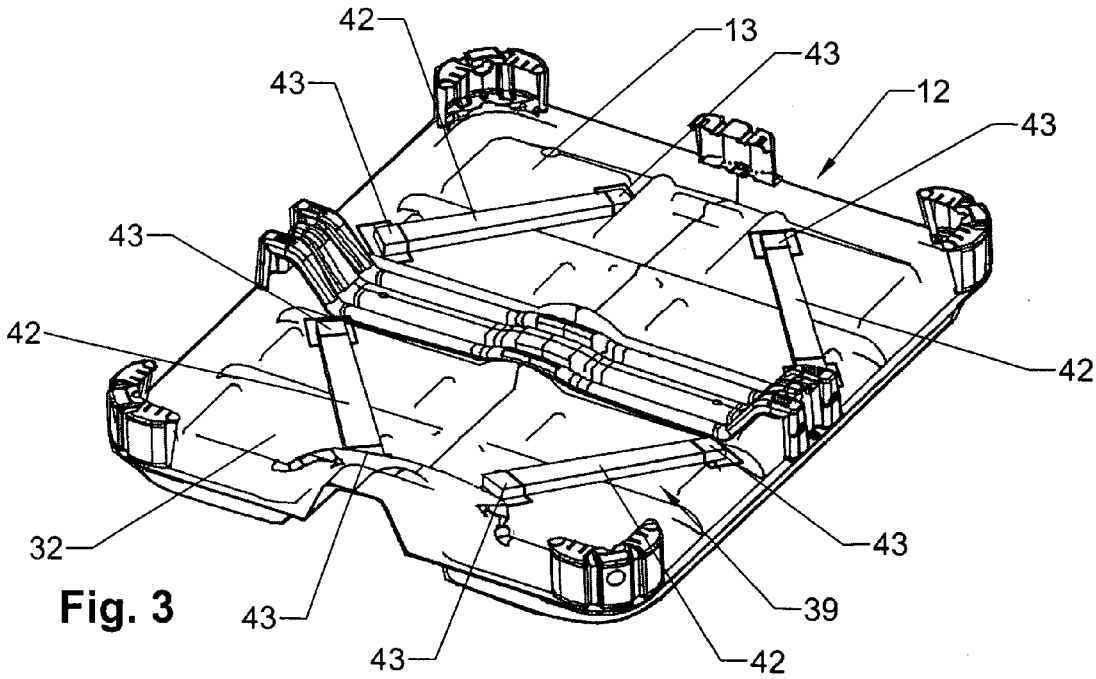
Fig. 3

Fig. 4
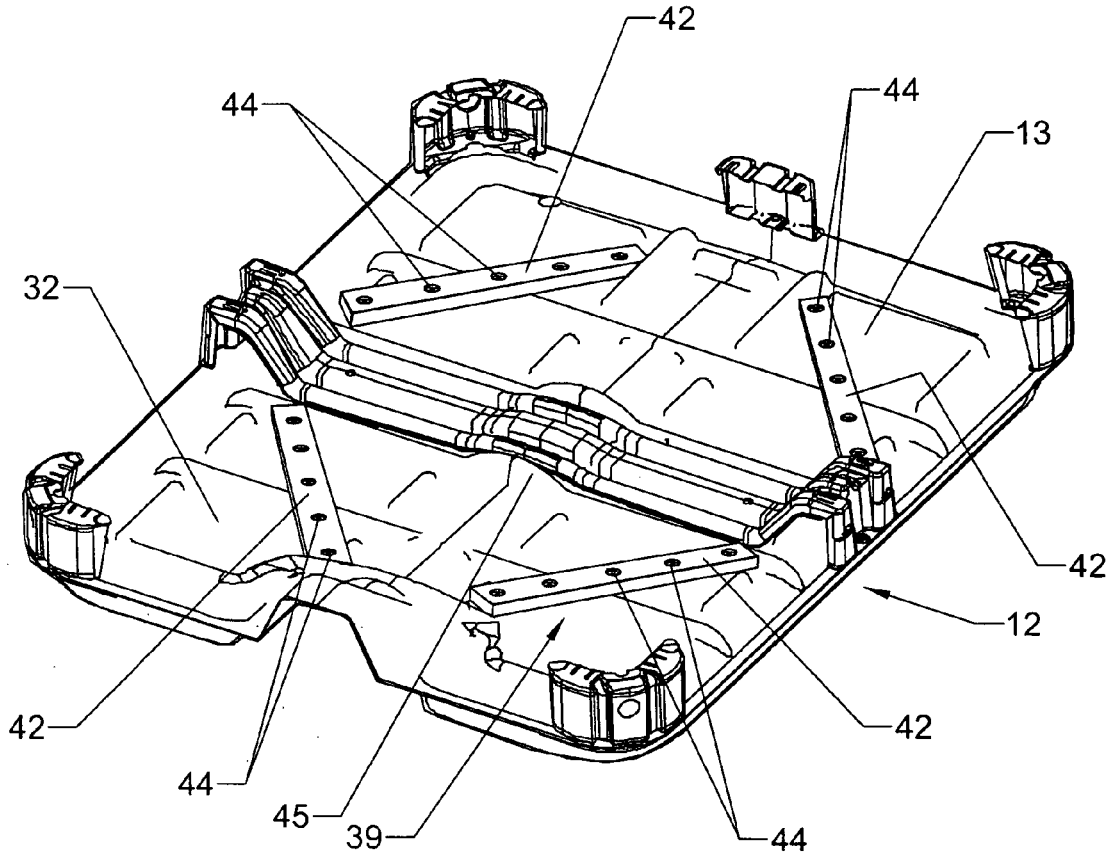
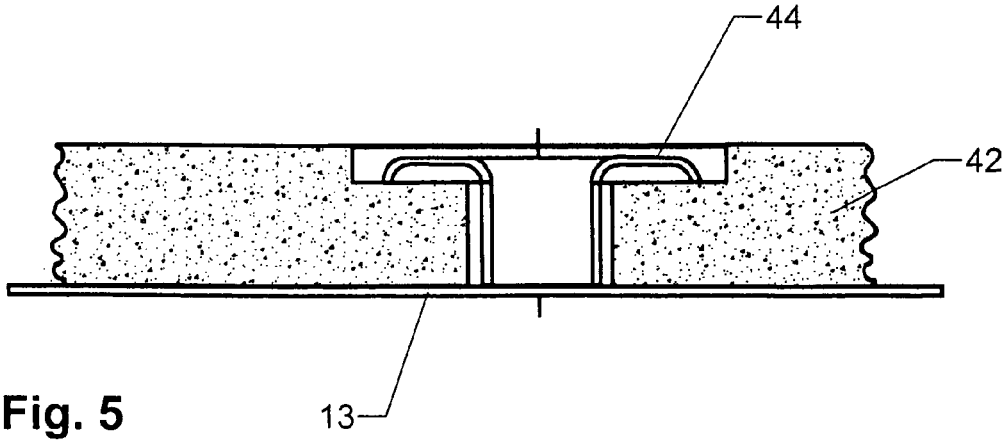
Fig. 5

Fig. 6
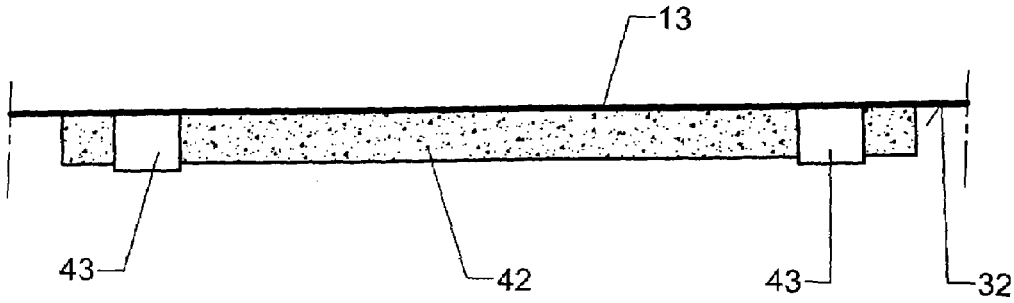
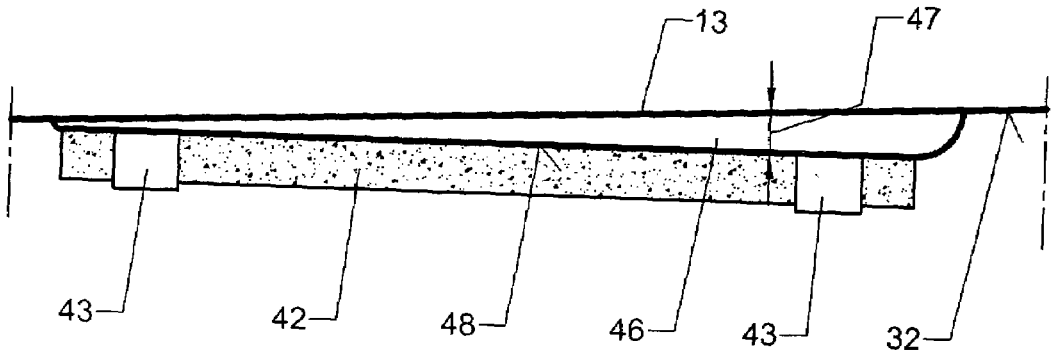
Fig. 7

PALLET-TYPE SUPPORT FRAME FOR TRANSPORT AND STORAGE CONTAINERS FOR LIQUIDS

BACKGROUND OF THE INVENTION

1. Field of the Invention

The invention relates to a pallet-type support frame for transport and storage containers for liquids that comprise an inner container of plastic material and an outer jacket comprised of a metal grid or sheet metal, wherein the support frame is designed for being handled by a forklift, storage shelf operating device or similar transport means and comprises a bottom of sheet metal supported on corner legs and central legs and configured for supporting the inner container that is provided with a closable filling spout and a discharge spout to be connected to a drainage fixture. The inner container has a drainage bottom and the bottom of the support frame is matched to this drainage bottom and slopes from the longitudinal edges in the direction toward the center axis of the bottom and/or from the rear edge to the forward edge, or the bottom of the support frame is provided with a flat bottom that is matched to the flat bottom of the inner container.

2. Description of the Related Art

When transporting a support frame of the aforementioned kind disclosed in German patent DE 100 62 088 C2 together with a filled or empty liquid container supported thereon by means of a forklift, there is the risk that the support frame with liquid container can slip from the fork arms of the forklift and impact on the ground when maneuvering curves, when braking, when loading a transport vehicle with the container and unloading the container from a transport vehicle as well as when accidentally hitting an obstacle located along the travel path. Especially when transporting several stacked transport and storage containers with a forklift, this can lead to dangerous situations when the container stack supported on the fork arms of the forklift topples.

SUMMARY OF THE INVENTION

It is an object of the present invention to improve the transport safety of the support frame of the aforementioned kind for transporting transport and storage containers for liquids during transport by means of forklifts, storage shelf operating devices or similar transport means.

In accordance with the present invention, this is achieved by means of anti-slip support elements provided on the underside of the bottom of the support frame with which the support frame bottom during transport of a transport and storage container by means of a transport means provided with gripping arms rests on the gripping arms, wherein the material of the support elements of the support frame bottom and the material of the gripping arms of the transport means are matched relative to one another for obtaining a coefficient of friction as great as possible.

In accordance with the present invention, this is also achieved by means of a complete or partial anti-slip coating of the underside of the support frame bottom that rests on the gripping arms of a transport device when transporting a transport and storage container for liquids on a transport device having gripping arms, wherein the coating material of the support frame bottom and the material of the gripping arms of the transport means are matched to one another for obtaining a friction coefficient as great as possible.

By providing the pallet-type support frame of the transport and storage container for liquids according to the invention with anti-slip support elements with which the container, when being transported by a transport means having gripping arms, rests on the gripping arms, and by means of mutual matching of the material from which the support elements are manufactured and the material from which the gripping arms are manufactured for obtaining a friction coefficient as large as possible, slipping of one or several stacked liquid containers in the filled or empty state during loading onto and unloading from transport vehicles and during transport is prevented so that the liquid container is distinguished by a high transport safety. This transport safety of the liquid container can be achieved by a complete or partial coating by plastic material or rubber material on the underside of the support frame bottom of the liquid container that rests during transport on the gripping arms of the transport means.

BRIEF DESCRIPTION OF THE DRAWING

In the drawing:

FIG. 2 shows a perspective bottom view of a support frame bottom of the transport and storage container according to FIG. 1 with support elements in the form of disks that are made of plastic material or rubber;

FIG. 3 is a perspective bottom view of a support frame bottom with support elements that are configured as wooden slats that are connected to the bottom by means of securing mounts;

FIG. 4 is a bottom view of a support frame bottom with wooden slats riveted to the bottom in a view corresponding to that of FIG. 3;

FIG. 5 shows the attachment of a wooden slat on the support frame bottom with a tubular rivet;

FIG. 6 shows a longitudinal section of a wooden slat mounted on the support frame bottom so as to match the incline of the support frame bottom; and FIG. 7 shows a longitudinal section of a wooden slat that is attached to the support frame bottom parallel to the contact surface of the support frame.

DESCRIPTION OF THE PREFERRED EMBODIMENTS

Figure 1:
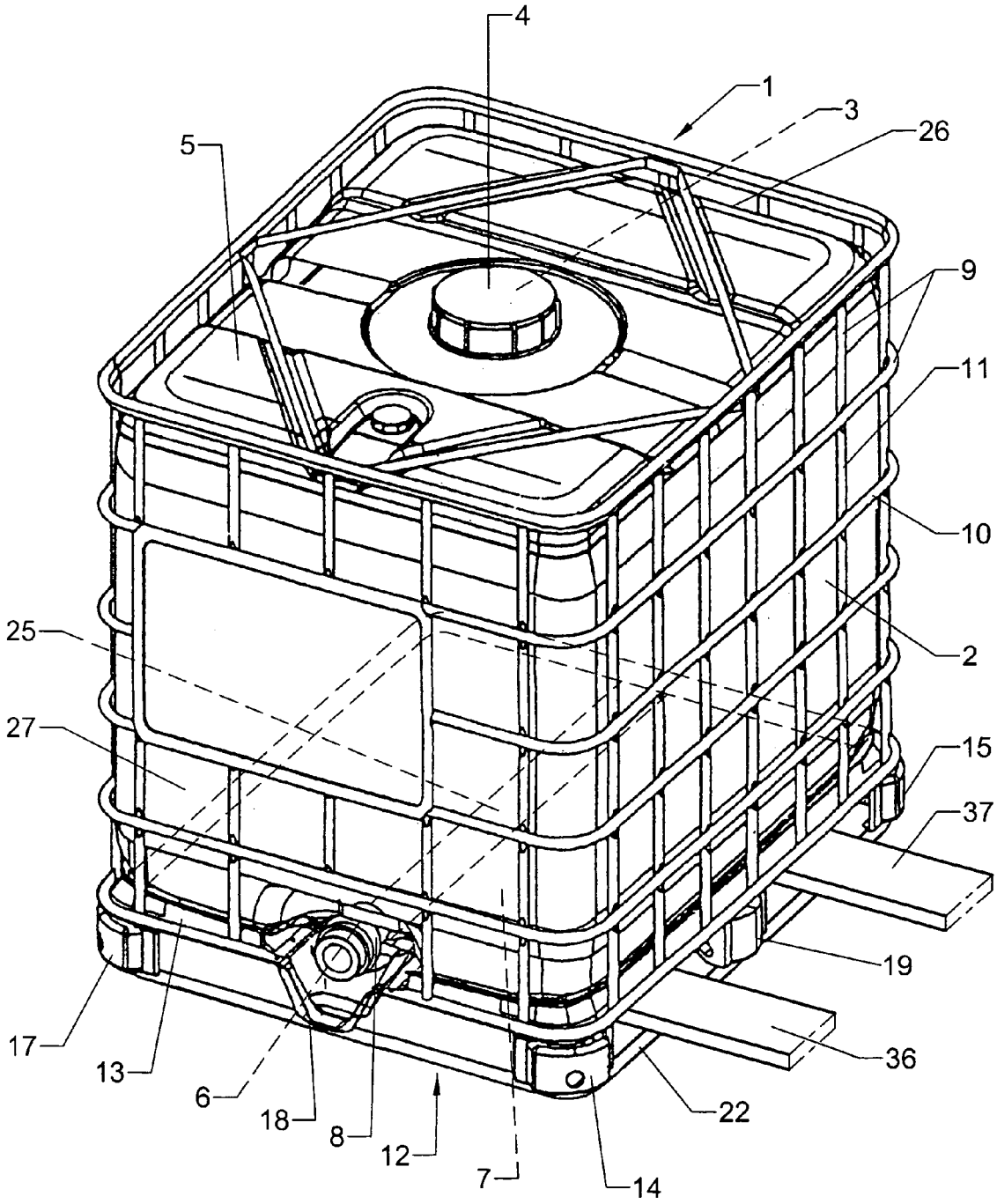
FIG. 1 shows a perspective illustration of the transport and storage container having a pallet-type support frame.

The transport and storage container for liquids that is configured as a disposable or reusable container has as a main component an exchangeable parallelepipedal inner container 2 made of plastic material that is provided at the top wall with a filling spout 3 that can be closed by a lid 4 and a drainage spout 6 in the area of the bottom 7 for connecting a drainage fixture 8 thereto. The transport and storage container further comprises an outer jacket 9 comprised of crossing metal bars 10, 11 and a pallet-type support frame 12 having length and width measurements that conform to Euronorm standards. The support frame is designed for being manipulated by means of a forklift, a storage shelf operating device or similar transport means.

The support frame 12 of the transport and storage container 1 is provided with a bottom 13 of sheet metal for supporting the inner container 2. The bottom 13 of the support frame 12 is positioned on four corner legs 14–17 and four central legs 18–21 made of sheet metal that are fastened to a steel pipe frame provided as a bottom frame 22.

Centrally underneath the bottom 13 of the support frame 12, a bridge-shaped reinforcement member 24 of sheet metal is attached like a girder by screws and extends transversely to the central axis 23—23 of the bottom. The central legs 19, 21 are formed as a unitary part of the member 24 at the two ends 24*a*, 24*b*.

The bottom 7 of the inner container 2 is designed as a drainage bottom having a central flat drainage groove 25 that extends at a slight incline from the back wall 26 to the drainage spout 6 provided at the front wall 27 of the inner container 2. The bottom 13 of the support frame 12 matched to the bottom 7 of the inner container 2 drops from the longitudinal edges 28, 29 to the central axis 23—23 and from the rear edge 32 to the forward edge 31.

The bottom 13 of the support frame 12 illustrated in FIG. 2 has at its underside 32 reinforcement corrugations 33, 34 extending in the direction of the central axis 23—23 and transversely thereto, wherein the bottom areas 35 of the grooves 33, 34 are located in a common horizontal plane so that the bottom 13 of the support frame 12 of the transport and storage container 1 rests horizontally on the gripping arms 36, 37 of a forklift or the shelf operating device that are moved underneath the bottom 13 of the support frame 12.

At the underside 38*a* of the central groove-shaped recess 38 of the bottom 13 of the support frame 12, the reinforcement corrugations 34 provided on the bottom side 32, and the reinforcement member 24, anti-slip support elements 39 are provided with which the support frame bottom 13 during transport of a transport and storage container 1 by means of a forklift rests on the gripping arms (fork arms) 36, 37. The support elements 39 are flexible disks or plates 40 of plastic material or rubber that are glued to the bottom 13 of the support frame 12 and, for increasing the friction coefficient, can have a textured surface 41.

Moreover, the support elements 39 of the support frame bottom 13 can be made of a fabric material.

When having an appropriate thickness and material strength, the anti-slip support elements 39 configured as stiff disks or plates 40 can be screwed or riveted to the bottom 13 of the support frame 12.

FIG. 3 shows a support frame 12 with a bottom 13 that is matched to the drainage bottom 7 of the inner container 2 of a transport and storage container 1. The bottom 13 is provided with support elements 39 in the form of wooden slats 42 that are fastened by securing mounts 43 welded to the bottom side 32 of the bottom 13. The wooden slats 42 serve as an anti-slip means for the support frame 12 during transport on the gripping arms 36, 37 of a transport device and for reinforcing the support frame bottom 13. In place of the wooden slats, it is also possible to employ plastic slats with a rough surface as a anti-slip support elements for the container support frame.

FIGS. 4 and 5 illustrate an attachment of the wooden slats 42 on the bottom 13 of the support frame 12 by means of tubular rivets 44.

The wooden slats 42 are aligned to a square shape concentrically to the central area 45 of the support frame bottom 13. In this way, it is ensured that the pallet-type support frame 12 of the transport and storage container 1 can be accessed from all four sides by the gripping arms 36, 37 of a transport device and, when the liquid container 1 is lifted by the transport device, the support frame bottom 13 rests with the wooden slats 42 on the gripping arms 36, 37 of the transport device.

According to FIG. 6, the wooden slats 42 can be attached to the bottom side 32 of the bottom 13 at an incline that is matched to the incline of the support frame bottom 13. According to FIG. 7, the wooden slats 42 can be attached to the bottom side 32 of the bottom 13 such that their bottom side is horizontal or parallel to the contact surface of the support frame 12.

FIG. 7 illustrates that a horizontal alignment of the wooden slats 42 is achieved by attachment thereof on corresponding corrugations 46 of the support frame bottom 13 whose depth 47 decreases from the periphery (exterior) to the center of the support frame so that the bottom 48 of the corrugation 46 extends horizontally in this way.

A horizontal alignment of the wooden slats can also be realized by a slanted configuration of the top side of the wooden slat or by placing a shim part or wedge whose top side has an incline matching the incline of the underside of the support frame bottom 13 against the underside of the bottom 13.

A further type of anti-slip embodiment of the support frame 12 of the transport and storage container for a transport with transport devices that are provided with gripping arms 36, 37 resides in a complete or partial anti-slip coating of the underside 32 of the support frame bottom 13 that rests on the gripping arms 36, 37 during transport, wherein the coating is comprised of material such as plastic material or rubber for obtaining a friction coefficient as great as possible between the support frame bottom 13 and the gripping arms 36, 37.

The afore described anti-slip configuration of the pallet-type support frame for transport and storage containers for liquids by a configuration of the support frame with support elements or a coating of the support frame bottom for obtaining a friction coefficient as great as possible between the underside of the support frame bottom and the support surface of the gripping arm of the transport device is suitable in the same way for support frames having a flat bottom that is matched to the flat bottom of an inner container of a transport and storage container.

While specific embodiments of the invention have been shown and described in detail to illustrate the inventive principles, it will be understood that the invention may be embodied otherwise without departing from such principles.

What is claimed is:

1. A pallet-type support frame for transport and storage containers for liquids, wherein the transport and storage container comprises an inner container of plastic material and an outer jacket comprised of a metal grid or sheet metal, wherein the inner container has a closable filling spout and a drainage spout configured to receive a drainage fixture, the support frame comprises:

a bottom made of sheet metal and adapted to support an inner container that has a drainage bottom or a flat bottom, wherein the bottom is adapted to be manipulated by a transport device;

corner legs and central legs connected to an underside of the bottom;

wherein the bottom has a shape matched to the drainage bottom or the flat bottom of the inner container;

anti-slip support elements provided on the underside of the bottom of the support frame, wherein the anti-slip support elements are arranged such that the support frame when transported by gripping arms of the transport device rests with the anti-slip support elements on the gripping arms;

wherein the anti-slip support elements are comprised of a material that is matched to a material of the gripping arms such that a coefficient of friction as great as possible is provided between the support elements and the gripping arms;

wherein the support elements are slats or plates comprised of wood or plastic material;

wherein the bottom has an incline to match an incline of a drainage bottom of the inner container, wherein the slats are attached with an incline matching the incline of the bottom to the underside of the bottom.

2. The support frame according to claim 1, wherein slats or plates provide a reinforcement of the bottom.

3. A pallet-type support frame for transport and storage containers for liquids, wherein the transport and storage container comprises an inner container of plastic material and an outer jacket comprised of a metal grid or sheet metal, wherein the inner container has a closable filling spout and a drainage spout configured to receive a drainage fixture, the support frame comprises:

a bottom made of sheet metal and adapted to support an inner container that has a drainage bottom or a flat bottom, wherein the bottom is adapted to be manipulated by a transport device;

corner legs and central legs connected to an underside of the bottom;

wherein the bottom has a shape matched to the drainage bottom or the flat bottom of the inner container;

anti-slip support elements provided on the underside of the bottom of the support frame, wherein the anti-slip support elements are arranged such that the support frame when transported by gripping arms of the transport device rests with the anti-slip support elements on the gripping arms;

wherein the anti-slip support elements are comprised of a material that is matched to a material of the gripping arms such that a coefficient of friction as great as possible is provided between the support elements and the gripping arms;

wherein the support elements are slats or plates comprised of wood or plastic material;

wherein the bottom has an incline to match an incline of a drainage bottom of the inner container, wherein the slats have a top side having an incline matched to the incline of the bottom so that the slats have a bottom side that extends horizontally.

4. A pallet-type support frame for transport and storage containers for liquids, wherein the transport and storage container comprises an inner container of plastic material and an outer jacket comprised of a metal grid or sheet metal, wherein the inner container has a closable filling spout and a drainage spout configured to receive a drainage fixture, the support frame comprises:

a bottom made of sheet metal and adapted to support an inner container that has a drainage bottom or a flat bottom, wherein the bottom is adapted to be manipulated by a transport device;

corner legs and central legs connected to an underside of the bottom;

wherein the bottom has a shape matched to the drainage bottom or the flat bottom of the inner container;

anti-slip support elements provided on the underside of the bottom of the support frame, wherein the anti-slip support elements are arranged such that the support frame when transported by gripping arms of the transport device rests with the anti-slip support elements on the gripping arms;

wherein the anti-slip support elements are comprised of a material that is matched to a material of the gripping arms such that a coefficient of friction as great as possible is provided between the support elements and the gripping arms;

wherein the support elements are slats or plates comprised of wood or plastic material;

wherein the bottom has an incline to match an incline of a drainage bottom of the inner container, wherein the bottom has corrugations having a depth that decreases from a periphery of the support frame toward a center of the support frame, wherein the slats are arranged on the corrugations so that the slats have a bottom side that extends horizontally.

5. A pallet-type support frame for transport and storage containers for liquids, wherein the transport and storage container comprises an inner container of plastic material and an outer jacket comprised of a metal grid or sheet metal, wherein the inner container has a closable filling spout and a drainage spout configured to receive a drainage fixture, the support frame comprises:

a bottom made of sheet metal and adapted to support an inner container that has a drainage bottom or a flat bottom, wherein the bottom is adapted to be manipulated by a transport device;

corner legs and central legs connected to an underside of the bottom;

wherein the bottom has a shape matched to the drainage bottom or the flat bottom of the inner container;

anti-slip support elements provided on the underside of the bottom of the support frame, wherein the anti-slip support elements are arranged such that the support frame when transported by gripping arms of the transport device rests with the anti-slip support elements on the gripping arms;

wherein the anti-slip support elements are comprised of a material that is matched to a material of the gripping arms such that a coefficient of friction as great as possible is provided between the support elements and the gripping arms;

wherein the support elements are slats or plates comprised of wood or plastic material;

wherein the bottom has an incline to match an incline of a drainage bottom of the inner container, wherein the slats are arranged on the bottom with interposition of shims such that the slats have a bottom side that extends horizontally.

6. A pallet-type support frame for transport and storage containers for liquids, wherein the transport and storage container comprises an inner container of plastic material and an oilier jacket comprised of a metal grid or sheet metal, wherein the inner container has a closable filling spout and a drainage spout configured to receive a drainage fixture, the support frame comprises:

a bottom made of sheet metal and adapted to support an inner container that has a drainage bottom or a flat bottom, wherein the bottom is adapted to be manipulated by a transport device;

corner legs and central legs connected to an underside of the bottom;

wherein the bottom has a shape matched to the drainage bottom or the flat bottom of the inner container;

anti-slip support elements provided on the underside of the bottom of the support frame, wherein the anti-slip support elements are arranged such that the support frame when transported by gripping arms of the transport device rests with the anti-slip support elements on the gripping arms;

wherein the anti-slip support elements are comprised of a material that is matched to a material of the gripping arms such that a coefficient of friction as great as possible is provided between the support elements and the gripping arms;

wherein the support elements are slats or plates comprised of wood or plastic material;

wherein the slats are aligned in a square shape concentrically to a central area of the bottom of the support frame bottom.

7. The support frame according to claim 1, wherein the slats are attached with hollow rivets to the bottom of the support frame.

8. The support frame according to claim 1, further comprising securing mounts for attaching the slats to the bottom of the support frame.

9. The support frame according to claim 1, wherein the bottom is provided with reinforcement corrugations.

* * * * *